US008584425B2

(12) United States Patent
Wagner et al.

(10) Patent No.: US 8,584,425 B2
(45) Date of Patent: Nov. 19, 2013

(54) MOUNTING CLIP AND WALL PANEL ASSEMBLY AS WELL AS KIT AND METHOD

(75) Inventors: Wayne M. Wagner, West St. Paul, MN (US); Robert T. Griffiths, Elk River, MN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 0 days.

(21) Appl. No.: 13/435,784

(22) Filed: Mar. 30, 2012

(65) Prior Publication Data

US 2012/0247052 A1 Oct. 4, 2012

Related U.S. Application Data

(60) Provisional application No. 61/470,428, filed on Mar. 31, 2011.

(51) Int. Cl.
*E04B 2/00* (2006.01)

(52) U.S. Cl.
USPC ..... 52/588.1; 52/782.1; 52/483.1; 52/545

(58) Field of Classification Search
USPC ..... 52/483.1, 489.1, 489.2, 588.1, 782.1, 52/798.1, 543–547, 550–552
See application file for complete search history.

(56) References Cited

U.S. PATENT DOCUMENTS

| | | | | |
|---|---|---|---|---|
| 6,289,646 | B1 * | 9/2001 | Watanabe | 52/506.01 |
| 8,051,623 | B2 * | 11/2011 | Loyd | 52/747.1 |
| 8,210,503 | B2 * | 7/2012 | Garrison | 256/24 |
| 8,336,273 | B2 * | 12/2012 | Enns | 52/588.1 |
| 8,341,901 | B2 * | 1/2013 | Loyd | 52/235 |

* cited by examiner

*Primary Examiner* — William Gilbert
*Assistant Examiner* — Gisele Ford
(74) *Attorney, Agent, or Firm* — Jason A. Houser; Fay Sharpe LLP

(57) ABSTRACT

A mounting clip and wall panel assembly is dimensioned for securement along an associated wall structure. The wall panel is formed from a thin-walled material having a substantially uniform thickness. The wall panel has a longitudinally-extending length, and includes first and second longitudinally-extending edges with a mounting wall portion extending lengthwise along the first edge. The mounting clip includes a fastener portion dimensioned for securement along the associated wall structure, and a panel-engaging portion configured to interengage the mounting wall portion of the wall panel. A mounting clip and wall panel kit, and a method of assembly are also included.

20 Claims, 11 Drawing Sheets

MOUNTING CLIP AND WALL PANEL ASSEMBLY AS WELL AS KIT AND METHOD

This application claims priority from U.S. Provisional Patent Application No. 61/470,428, filed on Mar. 31, 2011, which is hereby incorporated herein by reference in its entirety.

BACKGROUND

The subject matter of the present disclosure broadly relates to the art of building materials and, more particularly, to a mounting clip and wall panel combination adapted for securement on or along a wall structure. The mounting clip and wall panel combination may find particular application and use in connection with aesthetic coverings for interior and exterior wall structures, and will be described with particular reference thereto. However, it is to be appreciated that the subject matter of the present disclosure may also be amenable to use in connection with other applications.

Wall panels of a wide variety of types, kinds and constructions are well known and commonly used as finishing elements that are secured to wall structures, such as, for example, to provide aesthetic appeal and/or to conceal undesirable features of a building structure that would otherwise remain exposed. In some cases, conventional wall panels may be installed along the exterior of a building structure. In addition to improving the aesthetic appearance of a building structure, such wall panels can also serve to cover elements of the building structure as an initial layer of protection from the exterior environment (i.e., weather conditions).

Typically, wall panels are formed from thin-walled metal or plastic material, and can be roll-formed from elongated lengths of sheet material. In other cases, wall panels can be extruded into elongated lengths having the desired cross-sectional profile. Regardless of the material and/or method of manufacture, wall panels are generally dimensioned for and/or otherwise adapted for securement on or along generally flat surfaces, areas or regions of the wall structure of a building.

A conventional wall panel is typically used in combination with other wall panels to cover a portion of the wall structure. The wall panels are generally installed in an overlapping pattern and can, in such a manner, form an assembly on or along the wall structure of the building. In some cases, conventional wall panels are simply secured to the building structure using fasteners that directly engage the wall panel. In other cases, the wall panels can be secured on or along the building structure using mounting clips or brackets. The brackets can be attached to a wall panel, and the wall panel can be secured to the building structure using a fastener that is installed through the bracket.

The installation of wall panels on or along a building structure can also include interconnecting a joint element of one wall panel with a corresponding joint element of an adjacent wall panel. As a result, the action of positioning a conventional wall panel prior to securement on a wall structure can include the installer determining that the wall panel has been properly aligned along the wall structure and determining that any adjacent wall panels have been properly interengaged.

It will be appreciated that the action of positioning conventional wall panels during installation on a wall structure is labor intensive and time consuming to do properly such that an aesthetically pleasing result is achieved. Additionally, achievement of an aesthetically pleasing installation can call for near-constant attention and diligent effort of the installers to ensure that each wall panel is properly aligned and/or interconnected with adjacent wall panels. Such attention to detail can increase the time needed to complete the installation process, which can result in increased costs and reduced productivity of the installation team.

Notwithstanding the wide usage and overall success of conventional mounting bracket and wall panel designs, it is believed to be desirable to develop a mounting clip and wall panel combination that avoids or minimizes the foregoing and/or other problems and/or disadvantages encountered in connection with conventional designs.

BRIEF SUMMARY

One example of a mounting clip and wall panel assembly in accordance with the subject matter of the present disclosure can include a wall panel and a mounting clip. The wall panel can be formed from thin-walled material having a first panel side, a second panel side that is opposite the first panel side and a substantially uniform wall thickness between the first and second sides. The wall panel can extend longitudinally between a first end and a second end that is spaced from the first end such that a wall panel length is defined between the first and second ends. The wall panel can include a first longitudinal edge and a second longitudinal edge that is spaced apart from the first edge such that a wall panel height is defined between the first and second edges. A first joint element can extending lengthwise along the first edge, and a second joint element extending lengthwise along the second edge. The first and second joint elements can be dimensioned to cooperatively interengage a corresponding one of associated first and second joint elements on an associated second wall panel. A mounting wall portion can extend lengthwise along the first edge and can be disposed outwardly of the first joint element in a heightwise direction. The mounting bracket can operatively engaging the mounting wall portion of the wall panel, and can include a fastening portion that extends in a heightwise direction outwardly beyond the mounting wall portion of the wall panel. A panel engaging portion can be disposed along the mounting wall portion of the wall panel. The panel engaging portion can include first and second wall segments. The first wall segment can be disposed along the first panel side of the wall panel and can abuttingly engage the mounting wall portion along the first panel side. The second wall segment can be disposed along the second panel side of the wall panel and can abuttingly engage the mounting wall portion along the second panel side.

One example of a mounting clip and wall panel kit in accordance with the subject matter of the present disclosure can include a wall panel and a plurality of mounting brackets. The wall panel can be formed from thin-walled material having a first panel side, a second panel side opposite the first panel side and a substantially uniform wall thickness between the first and second panel sides. The wall panel can extend longitudinally between a first end and a second end that is spaced from the first end such that a wall panel length is defined between the first and second ends. The wall panel can include a first longitudinal edge and a second longitudinal edge that is spaced apart from the first edge such that a wall panel height is defined between the first and second edges. A first joint element can extend lengthwise along the first edge, and a second joint element extending lengthwise along the second edge. The first and second joint elements can be dimensioned to cooperatively interengage a corresponding one of associated first and second joint elements on an associated second wall panel. A mounting wall portion can extending lengthwise along the first edge and can be disposed outwardly of the first joint element in a heightwise direction. The plurality of mounting brackets can be dimensioned to operatively engage the mounting wall portion of the wall panel. The plurality of mounting brackets can include a fastening wall portion that extends in a heightwise direction and can be dimensioned to project outwardly beyond the mounting wall portion of the wall panel. The mounting brackets can also include a panel engaging portion that includes first and second wall segments that are dimensioned to receive the mounting wall portion of the wall panel such that the first wall segment can abuttingly engage the first panel side of the wall panel and the second wall segment can abuttingly engage the second panel side of the wall panel.

One example of a method of installing a wall panel in accordance with the subject matter of the present disclosure on a wall structure can include providing a wall panel. In some cases, the wall panel can be formed from thin-walled material having a first panel side, a second panel side opposite the first panel side and a substantially uniform wall thickness between the first and second sides. The wall panel can extend longitudinally between a first end and a second end spaced from the first end such that a wall panel length is defined between the first and second ends. The wall panel can include a first longitudinal edge and a second longitudinal edge that is spaced apart from the first edge such that a wall panel height is defined between the first and second edges. A first joint element can extend lengthwise along the first edge, and a second joint element can extend lengthwise along the second edge. The first and second joint elements can be dimensioned to cooperatively interengage a corresponding one of associated first and second joint elements on an associated second wall panel. A mounting wall portion can extend lengthwise along the first edge and can be disposed outwardly of the first joint element in a heightwise direction. The method can also include providing a mounting bracket. In some cases, the mounting bracket can include a fastening portion that extends in a heightwise direction and is dimensioned to project outwardly beyond the mounting wall portion of the wall panel. The mounting bracket can also include a panel engaging portion that includes first and second wall segments that are dimensioned to receive the mounting wall portion of the wall panel such that the first wall segment can abuttingly engage the first panel side of the wall panel and the second wall segment can abuttingly engage the second panel side of the wall panel. The method can further include orienting the mounting bracket along the mounting wall portion of the wall panel such that the panel engaging portion of the mounting bracket can engage the mounting wall portion with the first wall segment of the panel engaging portion disposed along the first panel side and the second wall segment of the panel engaging portion disposed along the second panel side. The method can also include securing the fastening portion of the mounting bracket to the wall structure.

DETAILED DESCRIPTION

Figure 1:
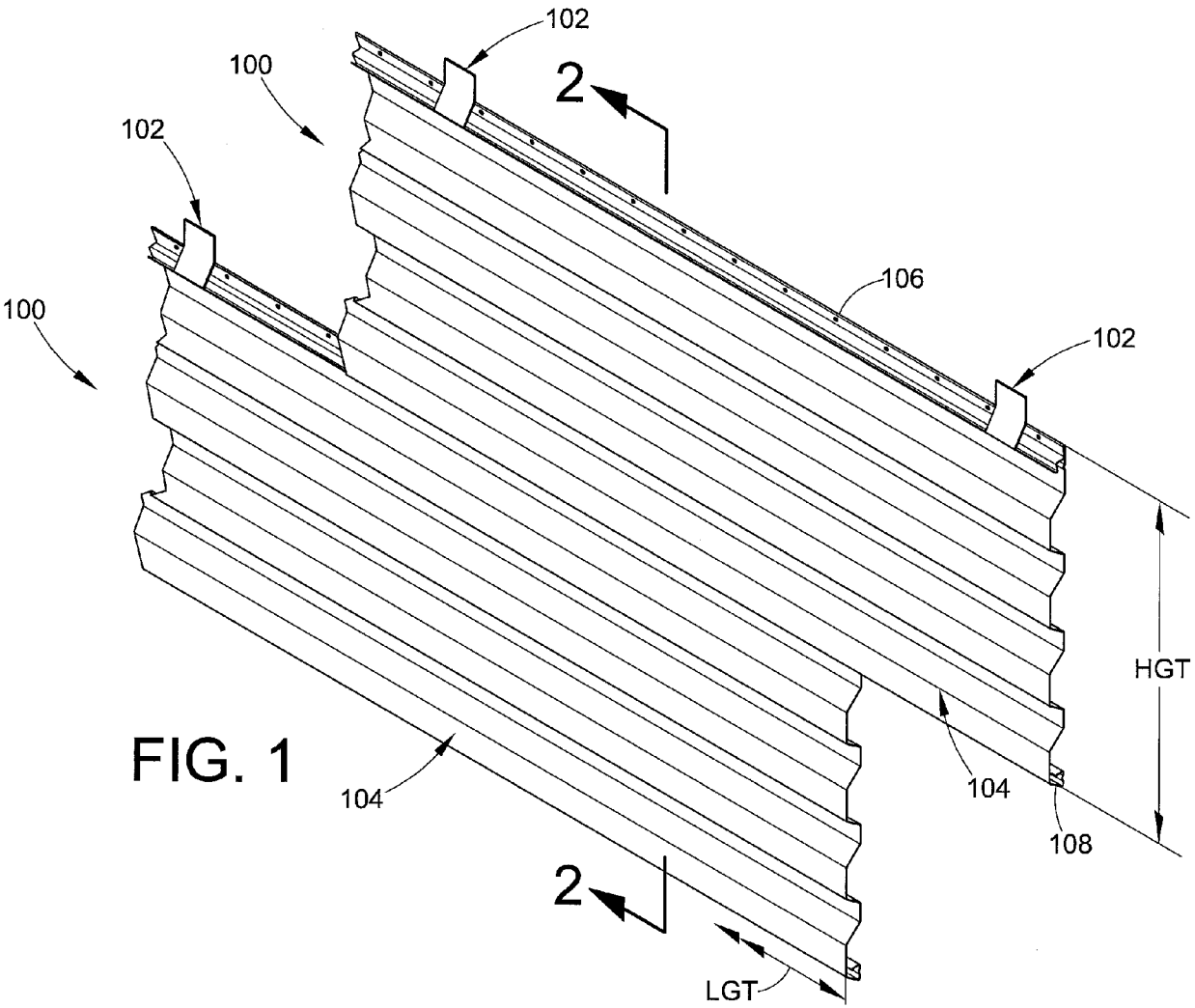
FIG. 1 is a perspective view of one example of a mounting clip and wall panel combination in accordance with the subject matter of the present disclosure with two instances shown supported on an associated wall structure.
Figure 2:
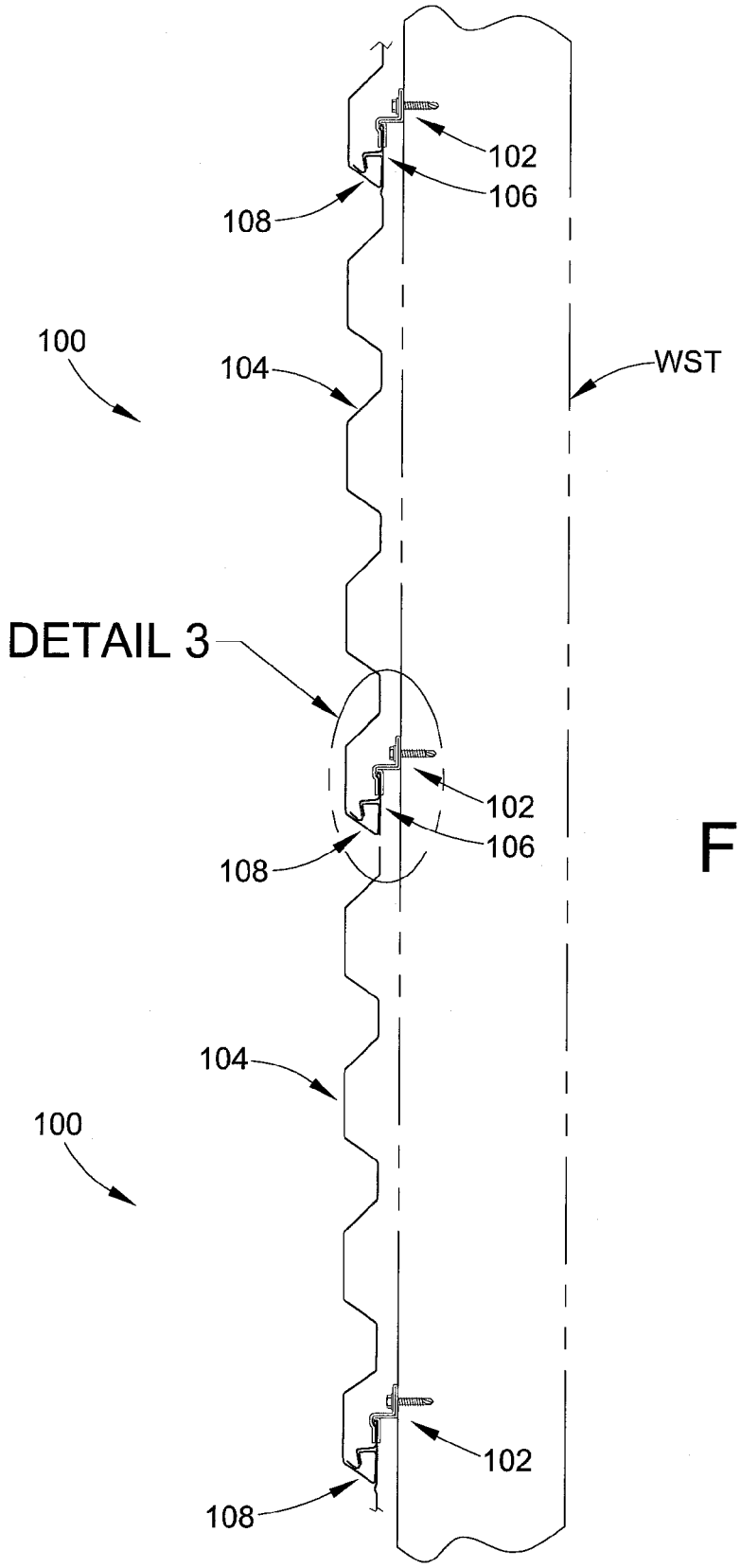
FIG. 2 is a cross sectional side view of the exemplary mounting clip and wall panel combination shown in FIG. 1.

Turning, now, to the drawings, wherein the showings are for the purposes of illustrating examples of the subject matter of the present disclosure and which are not intended to be limiting, FIGS. 1-4 illustrate one example of a mounting clip and wall panel combination 100, which may also be referred to herein as a mounting clip and wall panel assembly, that includes at least one mounting clip 102 and a wall panel 104. In FIGS. 1 and 2, a plurality of mounting clip and wall panel combinations 100 are shown installed on an associated wall structure WST (FIG. 2), such as an exterior wall of a building, for example. Wall panels are typically formed from thin-walled material, such as metal or polymeric material, for example. Additionally, wall panels, such as wall panels 104, for example, have an elongated length, which is represented in FIG. 1 by reference dimension LGT in FIG. 1, and longitudinally-extending edges 106 and 108 that at least partially define an overall height, which is represented in FIG. 1 by reference dimension HGT.

Wall panels 104 are shown in FIG. 1 as being of an indeterminate length. As such, it will be appreciated that any suitable length of wall panel can be used, such as a length within a range of from about 2 feet to about 50 feet, for example. Accordingly, it will be recognized that a plurality of mounting clips 102 can be spaced apart from one another along first longitudinal edge 106 of wall panel 104 and at suitably spaced distances. Wall panels 104 can also include first and second joint elements 110 and 112 that extend lengthwise along the wall panels adjacent first and second edges 106 and 108, respectively. The joint elements can be complimentary to one another and adapted to operatively interengage one another, such as to at least partially secure the wall panels together in an installed condition. Optionally, a seal 114 can be provided on, along or between the joint elements, such as may be suitable for minimizing the ingress of water and/or wind, for example.

Wall panels 104 can also include a mounting wall portion 116 that extends lengthwise along at least a portion of the wall panels. In some cases, the mounting wall portion may be secured on or along the wall panels adjacent the first edge. In the exemplary arrangement shown, however, mounting wall portion 116 is integrally formed as a portion of the wall panel and is positioned outwardly from joint element 110 in a heightwise direction. It will be appreciated that mounting wall portion 116 can be formed on or along wall panel 104 in any suitable manner. For example, a segment of the wall panel material can be folded together such that first edge 106 of the wall panel forms the terminal end of the mounting wall portion.

In some cases, a mounting bead can be pre-formed along the terminal end of the mounting wall portion, such as during the formation of corresponding longitudinal edge and/or the mounting wall portion, for example. It will be appreciated that such a bead can be of any suitable size, shape and/or configuration. In some cases, the mounting bead can have a regular or irregular cross-sectional shape that can be generally round (e.g., circular, ovoid, elliptical, bulbous, tear-drop, and polygonal with curved or rounded corners).

If provided, such a pre-formed mounting bead can be captured within mounting clip 102, which can inhibit displacement of the wall panel relative to the mounting clip in at least the heightwise direction. In other cases, a bead can be formed by the mounting clip during securement of the mounting clip on or along the mounting wall portion of the wall panel. In the exemplary arrangement shown in FIG. 3, mounting wall portion 116 is in a folded but unformed condition. As mounting clip 102 is secured on or along the mounting wall portion, the mounting clip can locally deform at least a portion of the unformed mounting wall portion into a shape that is capable of being retained within the mounting clip, such as a bead 118, for example, as is shown in FIG. 3A.

Figure 3:
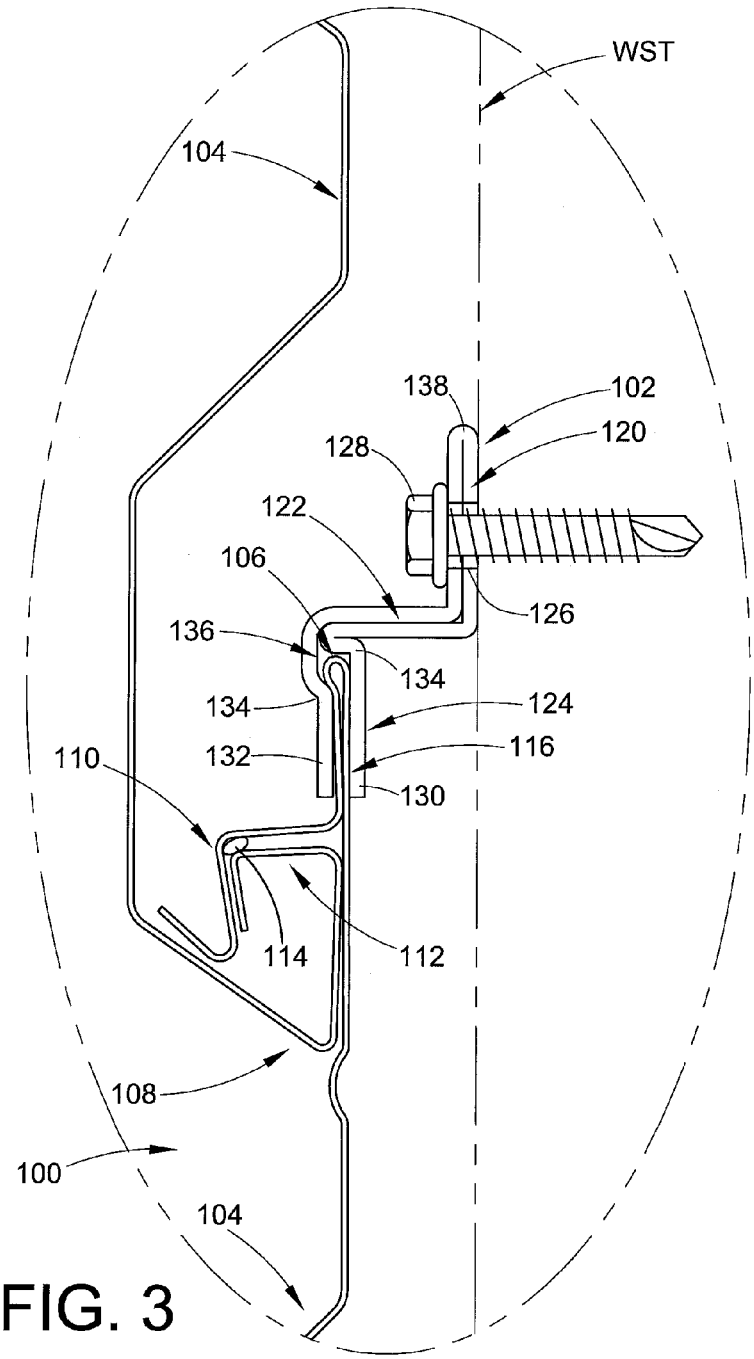
FIG. 3 is an enlarged view of the portion of the exemplary mounting clip and wall panel combination in FIGS. 1 and 2 identified in Detail 3 of FIG. 2.
Figure 3A:
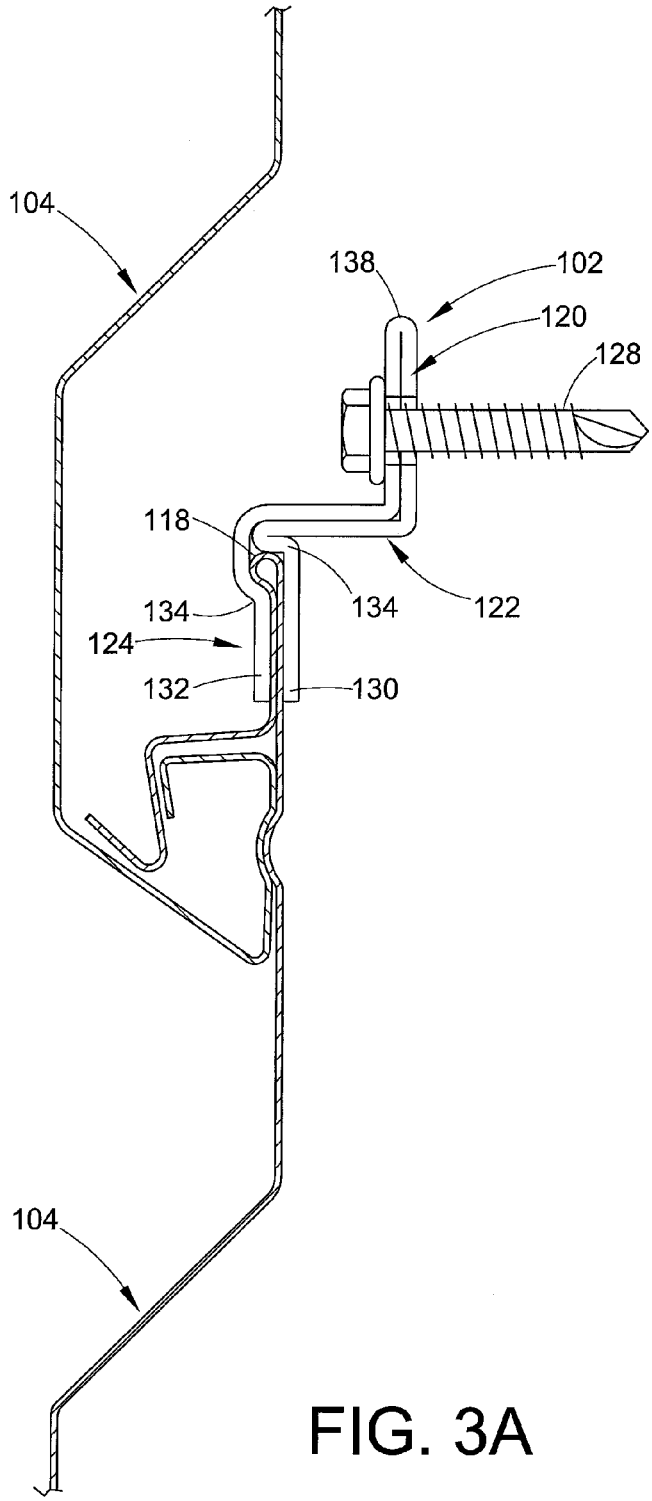
FIG. 3A is an alternate view of the portion of the exemplary mounting clip and wall panel combination in FIG. 3 shown with a bead formed along the wall panel.
Figure 4:
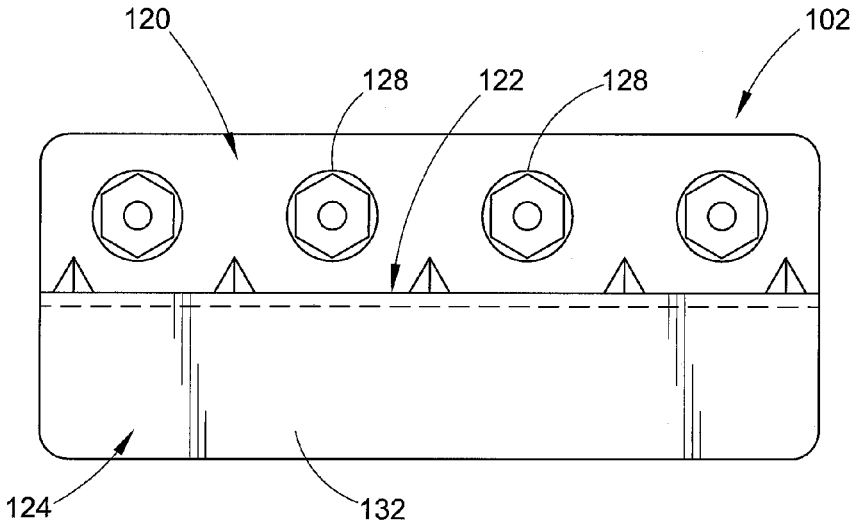
FIG. 4 is a front elevation view of the exemplary mounting clip in FIGS. 1-3.

As shown in FIGS. 3, 3A and 4, mounting clip 102 includes a fastener portion 120, an offset portion 122 and a panel-engaging portion 124. In the exemplary arrangement shown, mounting clip 102 is formed from sheet material (e.g., metal sheet stock) and is formed by folding the sheet material into the desired configuration. Fastener portion 120 includes at least one hole or passage 126 formed therethrough that is dimensioned to receive a suitable fastener, such as threaded screw 128, for example. In the exemplary embodiment shown in FIG. 4, a plurality of holes 126 are disposed in spaced relation to one another along fastener portion 120 and extend through the fastener portion for securement of the mounting clip to an associated wall structure.

Offset portion 122 functions to support the wall panel in spaced relation to the associated wall structure to which the mounting clip is secured. As such, it will be appreciated that offset portion 122 is optional and that panel-engaging portion 124 could extend directly from fastener portion 120. If included, offset portion 122 can be of any suitable size or length, such as from ¼ of an inch to 4 inches, for example. Panel-engaging portion 124 can include a first wall segment 130 and a second wall segment 132 that are spaced apart from one another such that mounting wall portion 116 can be received therebetween. One or more steps 134 can optionally be included in one or along either or both of wall segments 130 and 132 to form a recess 136 for receiving bead 118 or a similar feature, if provided.

The folded sheet metal construction of mounting clip 102 provides a hinge 138 formed along fastener portion 120 that permits wall segments 130 and 132 to be separated from one another to receive mounting wall portion 116 and bead 118, if provided. As the fasteners (e.g., threaded screws 128) are installed, the two wall segments of fastener portion 120 are forced together, which can cause wall segments 130 and 132 of panel-engaging portion 124 to capture mounting wall portion 116 and bead 118, if provided. In other cases, the force generated may be sufficient to form a suitable bead or other feature on or along the mounting wall portion.

Figure 5:
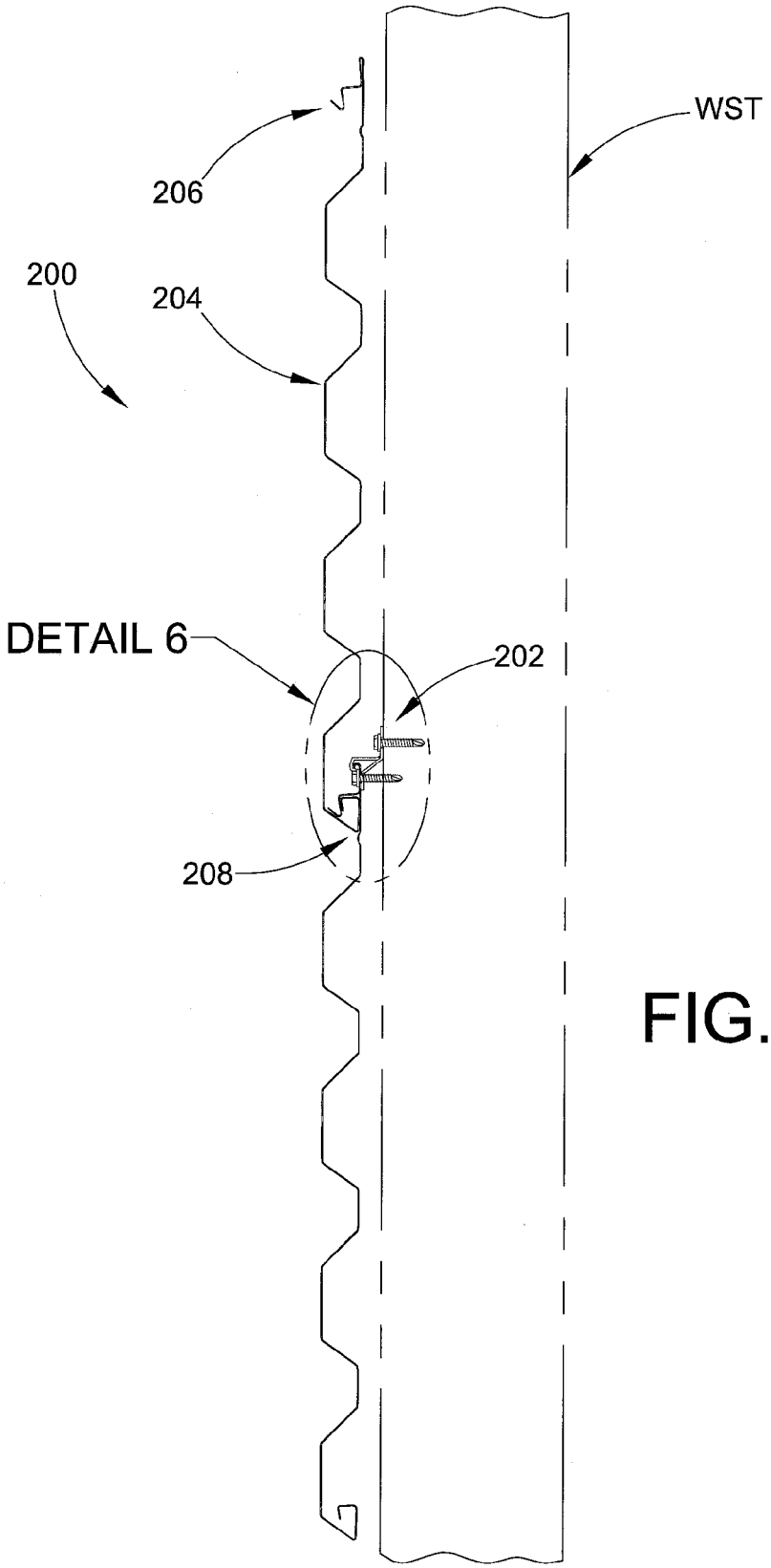
FIG. 5 is a cross sectional side view of another example of a mounting clip and wall panel combination in accordance with the subject matter of the present disclosure.
Figure 6:
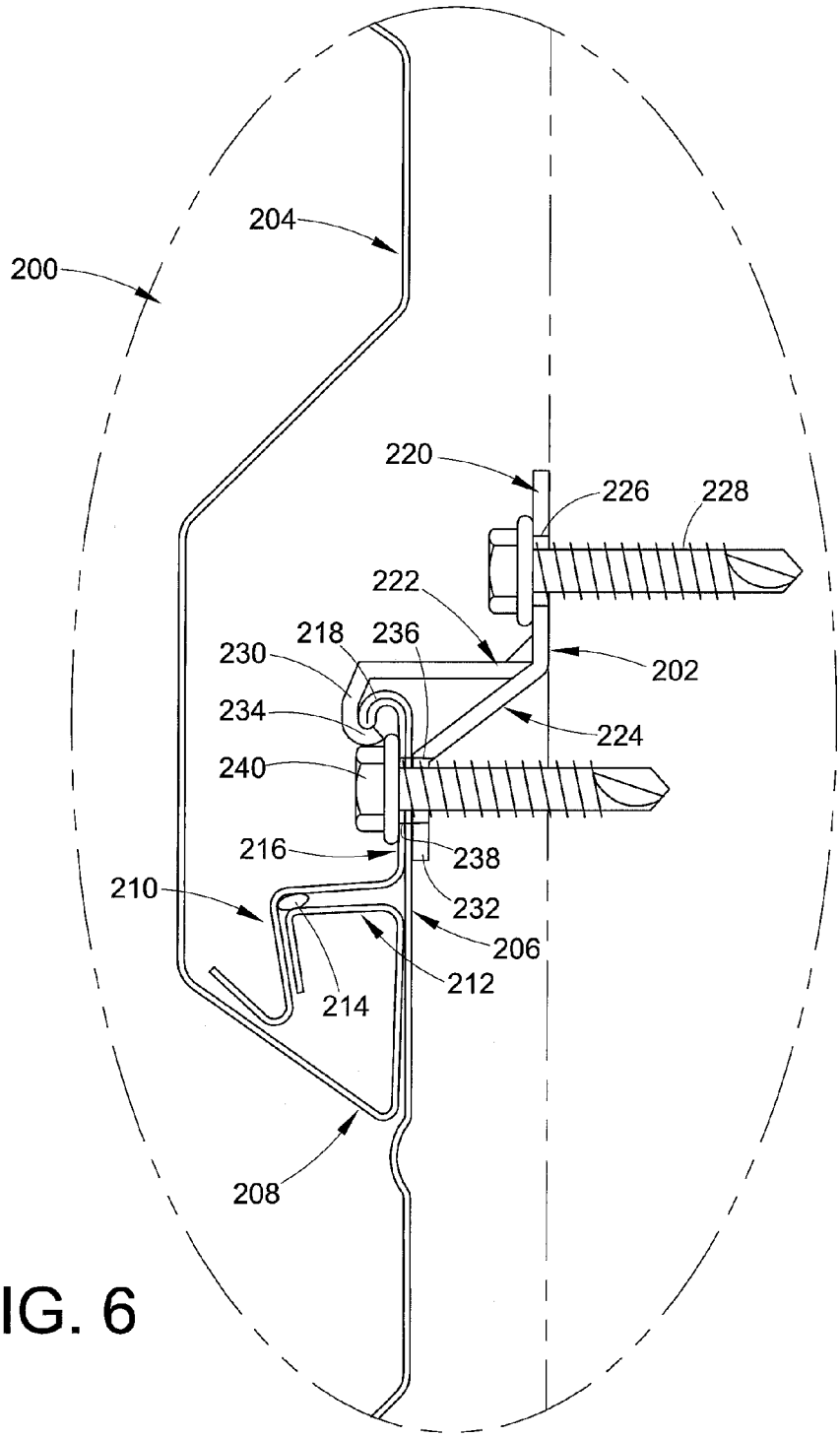
FIG. 6 is an enlarged view of the portion of the exemplary mounting clip and wall panel combination identified in Detail 6 of FIG. 5.
Figure 7:
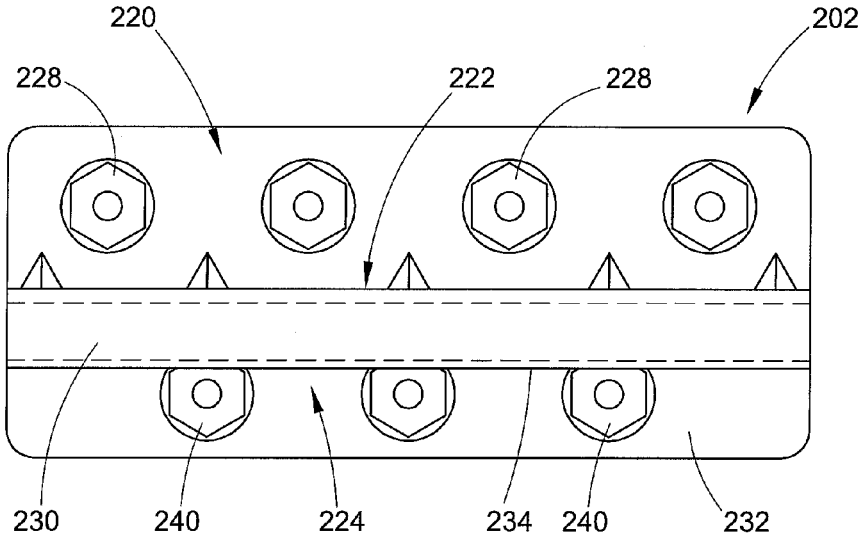
FIG. 7 is a front elevation view of the exemplary mounting clip in FIGS. 5 and 6.

FIGS. 5-7 illustrate another example of a mounting clip and wall panel combination 200 that includes at least one mounting clip 202 and a wall panel 204. As discussed above, a plurality of mounting clip and wall panel combinations 200 are shown installed on an associated wall structure WST (FIG. 5), such as an exterior wall of a building, for example. It will be appreciated that wall panel 204 is similar to wall panel 104 in overall structure. Wall panels are typically formed from thin-walled material, such as metal or polymeric material, for example. Additionally, wall panels, such as wall panels 204, for example, have an elongated length (which is represented in FIG. 1 by reference dimension LGT in FIG. 1) and longitudinally-extending edges 206 and 208 that at least partially define an overall height (which is represented in FIG. 1 by reference dimension HGT).

A plurality of mounting clips 202 can be spaced apart from one another along first longitudinal edge 206 of wall panel 204 and at suitably spaced distances, such as has been discussed above in connection with FIGS. 1-4. Wall panels 204 can also include first and second joint elements 210 and 212 that extend lengthwise along the wall panels adjacent first and second edges 206 and 208, respectively. The joint elements can be complimentary to one another and adapted to operatively interengage one another, such as to at least partially secure the wall panels together in an installed condition. Optionally, a seal 214 can be provided on, along or between the joint elements, such as may be suitable for minimizing the ingress of water and/or wind, for example.

Wall panels 204 can also include a mounting wall portion 216 that extends lengthwise along at least a portion of the wall panels. In some cases, the mounting wall portion may be secured on or along the wall panels adjacent the first edge. In the exemplary arrangement shown, however, mounting wall portion 216 is integrally formed as a portion of the wall panel and is positioned outwardly from joint element 210 in a heightwise direction. It will be appreciated that mounting wall portion 216 can be formed on or along wall panel 204 in any suitable manner. For example, a segment of the wall panel material can be folded together such that first edge 206 of the wall panel forms the terminal end of the mounting wall portion. Mounting wall portion 216 can also include a mounting bead that extends longitudinally along at least a portion thereof. It will be appreciated that such a bead can be of any suitable size, shape and/or configuration. In some cases, the mounting bead can have a regular or irregular cross-sectional shape that can include generally hook-shaped end 218 that can extend lengthwise along at least a portion of wall panel 204.

As shown in FIGS. 6 and 7, mounting clip 202 includes a fastener portion 220, an offset portion 222 and a panel-engaging portion 224. In the exemplary arrangement shown, mounting clip 202 is formed from sheet material (e.g., metal sheet stock) and is formed by bending various portions of the sheet material into the desired configuration. Fastener portion 220 includes at least one hole or passage 226 formed therethrough that is dimensioned to receive a suitable fastener, such as threaded screw 228, for example. In the exemplary embodiment shown in FIG. 7, a plurality of holes 226 are disposed in spaced relation to one another along fastener portion 220 and extend through the fastener portion for securement of the mounting clip to an associated wall structure.

Offset portion 222 functions to support the wall panel in spaced relation to the associated wall structure to which the mounting clip is secured. As such, it will be appreciated that offset portion 222 is optional and that panel-engaging portion 224 could extend directly from fastener portion 220. If included, offset portion 222 can be of any suitable size or length, such as from ¼ of an inch to 4 inches, for example.

Panel-engaging portion 224 can include a first wall segment 230 and a second wall segment 232. First wall segment 230 can have a cross-sectional shape that includes a hook-shaped end 234 that is dimensioned to receivingly engage hook-shaped end 218 of mounting wall portion 216 of the wall panel. Second wall segment 232 includes at least one hole or passage 236 extending therethrough that is capable of at least approximately aligning with a corresponding hole or passage 238 in mounting wall portion 216. In the exemplary arrangement shown in FIG. 7, a plurality of holes 236 extend through second wall segment 232 of panel-engaging portion 224. Holes 236 and 238 can be dimensioned to receive a suitable fastener, such as threaded screw 240, for example.

Wall panel 204 can be supported on mounting clip 202 by interengaging hook-shaped ends 218 and 234 such that the wall panel can be supported vertically on the mounting clip. Fasteners 240 can be used to secure the wall panel on or along at least second wall segment 232 of the mounting clip. The mounting clip together with the wall panel can be secured on or along the associated wall structure using fasteners 228.

Figure 8:
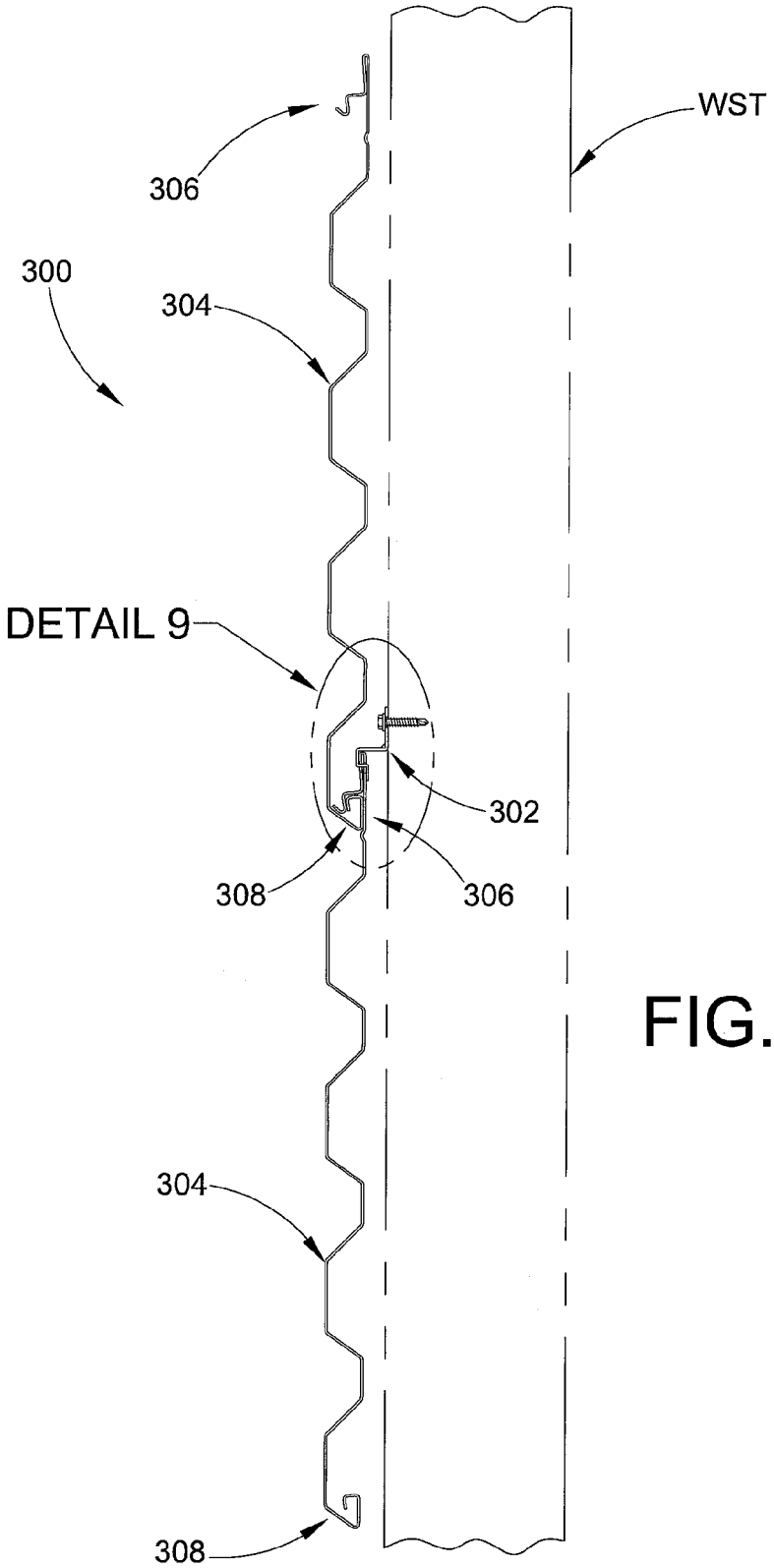
FIG. 8 is a cross sectional side view of a further example of a mounting clip and wall panel combination in accordance with the subject matter of the present disclosure.
Figure 9:
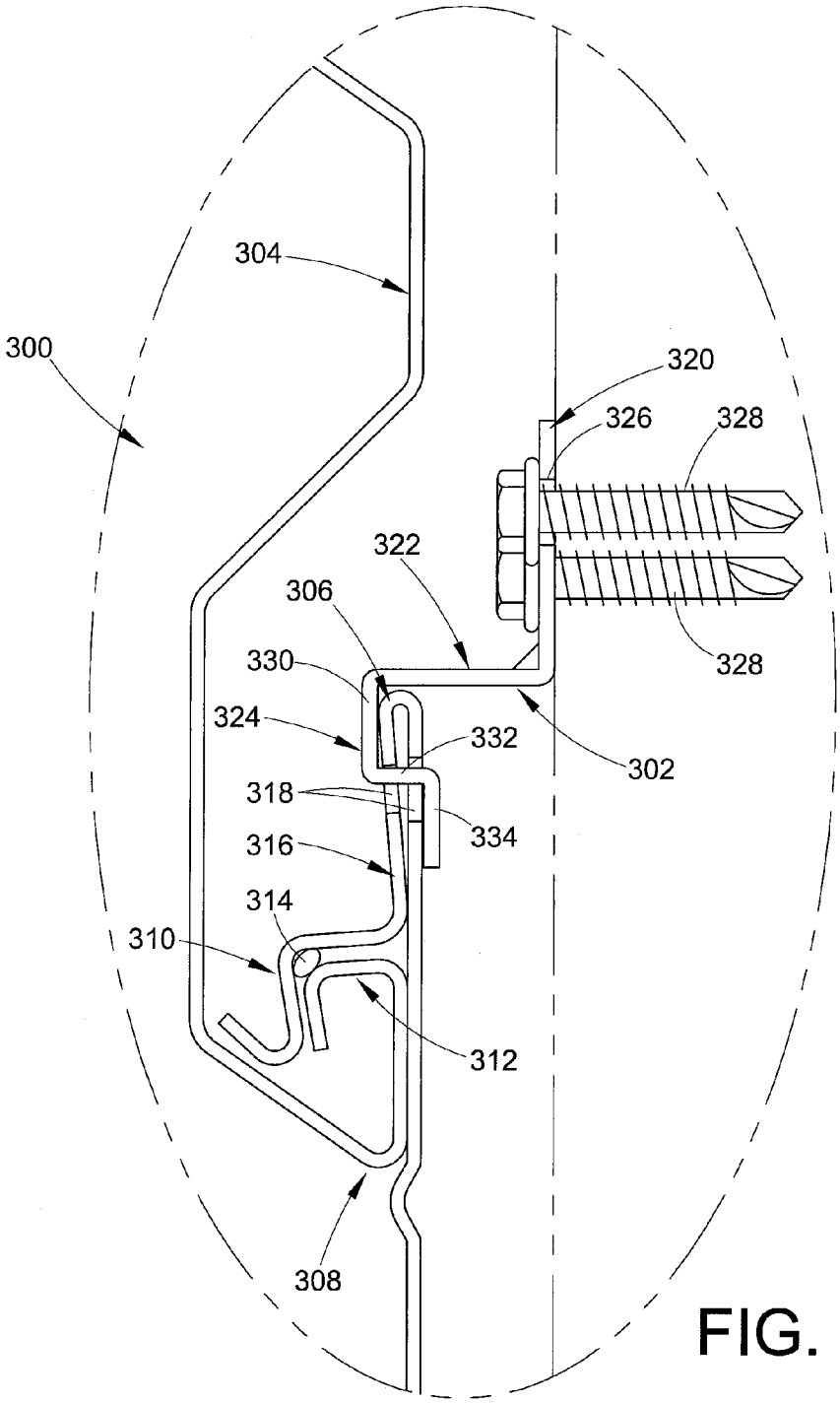
FIG. 9 is an enlarged view of the portion of the exemplary mounting clip and wall panel combination identified in Detail 9 of FIG. 8.
Figure 10:
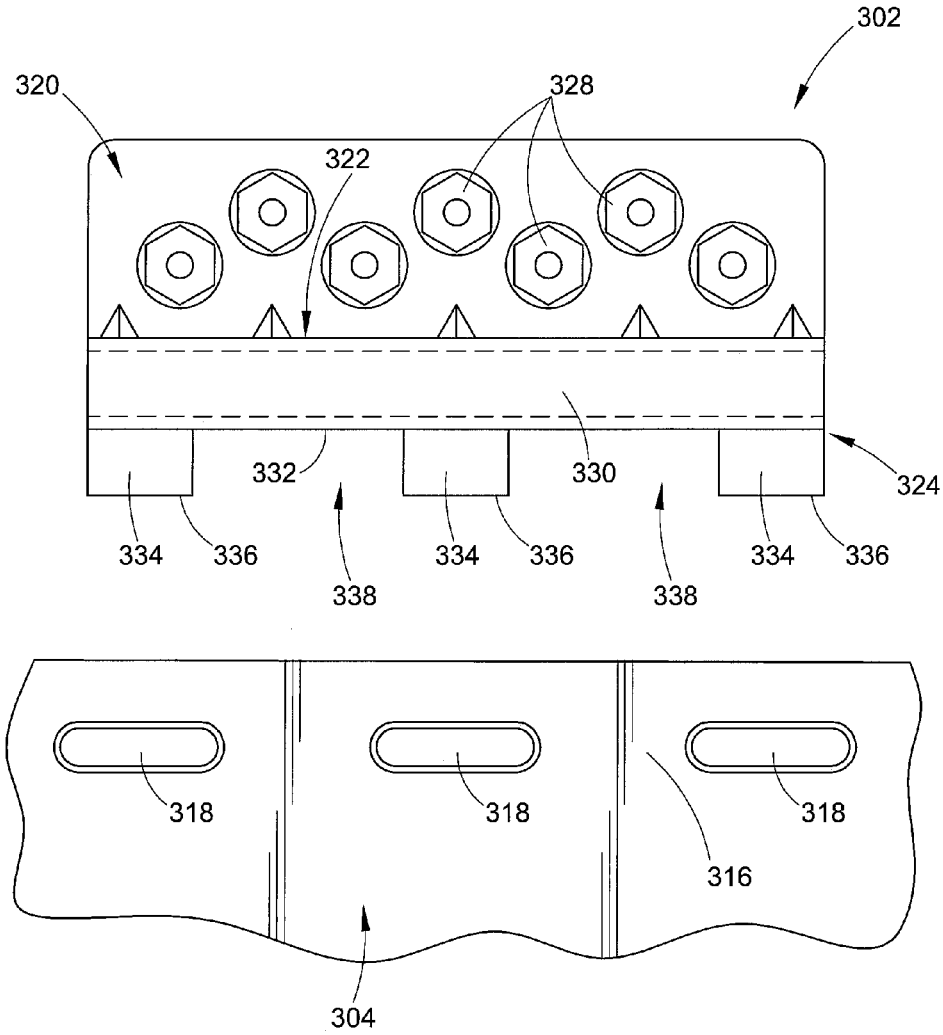
FIG. 10 is a front elevation view of the exemplary mounting clip and wall panel combination in FIGS. 8 and 9 shown prior to assembly.

FIGS. 8-10 illustrate another example of a mounting clip and wall panel combination 300 that includes at least one mounting clip 302 and a wall panel 304. As discussed above, a plurality of mounting clip and wall panel combinations 300 are shown installed on an associated wall structure WST (FIG. 8), such as an exterior wall of a building, for example. It will be appreciated that wall panel 304 is similar to wall panel 104 in overall structure. Wall panels are typically formed from thin-walled material, such as metal or polymeric material, for example. Additionally, wall panels, such as wall panels 304, for example, have an elongated length (which is represented in FIG. 1 by reference dimension LGT in FIG. 1) and longitudinally-extending edges 306 and 308 that at least partially define an overall height (which is represented in FIG. 1 by reference dimension HGT).

A plurality of mounting clips 302 can be spaced apart from one another along first longitudinal edge 306 of wall panel 304 and at suitably spaced distances, such as has been discussed above in connection with FIGS. 1-4. Wall panels 304 can also include first and second joint elements 310 and 312 that extend lengthwise along the wall panels adjacent first and second edges 306 and 308, respectively. The joint elements can be complimentary to one another and adapted to operatively interengage one another, such as to at least partially secure the wall panels together in an installed condition. Optionally, a seal 314 can be provided on, along or between the joint elements, such as may be suitable for minimizing the ingress of water and/or wind, for example.

Wall panels 304 can also include a mounting wall portion 316 that extends lengthwise along at least a portion of the wall panels. In some cases, the mounting wall portion may be secured on or along the wall panels adjacent the first edge. In the exemplary arrangement shown, however, mounting wall portion 316 is integrally formed as a portion of the wall panel and is positioned outwardly from joint element 310 in a heightwise direction. It will be appreciated that mounting wall portion 316 can be formed on or along wall panel 304 in any suitable manner. For example, a segment of the wall panel material can be folded together such that first edge 306 of the wall panel forms the terminal end of the mounting wall portion. Mounting wall portion 316 can also include a plurality of elongated slots or openings 318 (FIGS. 9 and 10) that are disposed in longitudinally spaced apart relation to one another along wall panel 304 adjacent first edge 306 thereof.

As shown in FIGS. 9 and 10, mounting clip 302 includes a fastener portion 320, an offset portion 322 and a panel-engaging portion 324. In the exemplary arrangement shown, mounting clip 302 is formed from sheet material (e.g., metal sheet stock) and is formed by bending various portions of the sheet material into the desired configuration. Fastener portion 320 includes at least one hole or passage 326 formed therethrough that is dimensioned to receive a suitable fastener, such as threaded screw 328, for example. In the exemplary embodiment shown in FIG. 10, a plurality of holes 326 are disposed in spaced relation to one another along fastener portion 320 and extend through the fastener portion for securement of the mounting clip to an associated wall structure.

Offset portion 322 functions to support the wall panel in spaced relation to the associated wall structure to which the mounting clip is secured. In this case, offset portion 322 permits wall panel 304 to be supported on panel-engaging portion 324 while fastener portion 320 abuttingly engages the associated wall structure. It will be appreciated, however, that offset portion 322 can be of any suitable size or length, such as from ¼ of an inch to 4 inches, for example.

Panel-engaging portion 324 can include a first wall segment 330 that projects from offset portion 322, a second wall segment 332 that projects from the first wall segment in a direction generally transverse thereto, and a plurality of third wall segments 334 that project from second wall segment 332 in a direction generally transverse thereto such that a free end 336 thereof is formed thereby. A plurality of spaces or gaps 338 are formed along the panel engaging portion with one space or gap positioned between adjacent ones of the third wall segments.

Third wall segments 334 are dimensioned for receipt into passages 318 in mounting wall portion 316. In this manner, the mounting clip and wall panel can be operatively interconnected with one another such that the wall panel can be supported on second wall segment 332, as is shown in FIG. 9, for example. Third wall segment 334 will inhibit the wall panel from sliding off of second wall segment 332 once second joint element 312 is operatively interengaged with a corresponding first joint element of an adjacent wall panel. The mounting clip and wall panel can be secured on or along the associated wall structure using threaded screws 328.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. Thus it is to be distinctly understood claims directed to any such combination of features and/or components, whether or not specifically embodied herein, are intended to find support in the present disclosure.

Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The invention claimed is:

1. A mounting bracket and wall panel assembly dimensioned for securement along an associated wall structure, said assembly comprising:

a wall panel formed from thin-walled material having a first panel side, a second panel side opposite said first panel side and a substantially uniform wall thickness between said first and second sides, said wall panel extending longitudinally between a first end and a second end spaced from said first end such that a wall panel length is defined between said first and second ends, said wall panel including:

a first longitudinal edge and a second longitudinal edge spaced apart from said first edge such that a wall panel height is defined between said first and second edges;

a first joint element extending lengthwise along said first edge, and a second joint element extending lengthwise along said second edge, said first and second joint elements dimensioned to cooperatively interengage a corresponding one of associated first and second joint elements on an associated second wall panel;

a mounting wall portion extending lengthwise along said first edge and disposed outwardly of said first joint element in a heightwise direction; and, a mounting bracket operatively engaging said mounting wall portion of said wall panel, said mounting bracket including:

a fastening portion extending in a heightwise direction outwardly beyond said mounting wall portion of said wall panel; and, a panel engaging portion disposed along said mounting wall portion of said wall panel, said panel engaging portion including first and second wall segments;

said first wall segment disposed along said first panel side of said wall panel and abuttingly engaging said mounting wall portion along said first panel side; and, said second wall segment disposed along said second panel side of said wall panel and abuttingly engaging said mounting wall portion along said second panel side.

2. An assembly according to claim 1, wherein said fastening portion and said panel engaging portion said mounting bracket are offset from one another in a direction transverse to said heightwise direction, and said mounting bracket includes an offset portion extending between and interconnecting said fastening portion and said panel engaging portion.

3. An assembly according to claim 1, wherein said fastening portion of said mounting bracket includes at least one opening extending therethrough and dimensioned to receive an associated fastener for securement of said mounting bracket along the associated wall structure.

4. An assembly according to claim 1, wherein said wall panel includes a mounting bead extending longitudinally along at least a portion of said mounting wall portion.

5. An assembly according to claim 4, wherein said mounting bead has a round-shaped cross-section.

6. An assembly according to claim 4, wherein said panel engaging portion of said mounting bracket includes a recess formed between said first and second wall segments, said recess dimensioned to at least partially receive said mounting bead of said mounting wall portion of said wall panel.

7. An assembly according to claim 6, wherein at least one of said first and second wall segments of said panel engaging portion includes a step that at least partially defines said recess.

8. An assembly according to claim 1, wherein said fastening portion includes first and second wall segments that are displaceable relative to one another.

9. An assembly according to claim 8, wherein a hinge wall portion operatively connects said first and second wall segments of said fastening portion.

10. An assembly according to claim 8, wherein said first wall segment of said fastening portion is connected to said first wall segment of said panel engaging portion, and said second wall segment of said fastening portion is connected to said second wall segment of said panel engaging portion such that displacement of said first and second wall segments of said fastening portion relative to one another results in displacement of said first and second wall segments of said panel engaging portion relative to one another.

11. An assembly according to claim 10, wherein said first wall segment of said fastening portion includes a first passage extending therethrough, said second wall segment of said fastening portion includes a second passage extending therethrough in approximate alignment with said first passage such that an associated fastener can extend through said fastening portion and displace said first and second wall segments of said fastening portion toward one another upon engagement of the associated fastener with the associated wall structure.

12. An assembly according to claim 11, wherein displacement of said first and second wall segments of said fastening portion biases said first and second wall segments of said panel engaging portion toward one another to thereby operatively engage said mounting wall portion of said wall panel.

13. An assembly according to claim 4, wherein said mounting bead has a hook-shaped cross section, and said first wall segment of said panel engaging portion has a corresponding hook-shaped cross section dimensioned to receivingly engage said hook-shaped cross section of said mounting bead.

14. An assembly according to claim 13, wherein said mounting wall portion includes an opening extending therethrough adjacent said mounting bead, and said second wall segment of said panel engaging portion includes an opening extending therethrough in approximate alignment with said opening in said mounting wall portion such that an associated fastener can extend through said openings to secure said second wall segment of said panel engaging portion in abutting engagement with said mounting wall portion.

15. An assembly according to claim 1, wherein said first and second wall segments of said panel engaging portion extend in a generally heightwise direction and are offset from one another in a direction transverse to said lengthwise direction and said heightwise direction by a third wall segment that extends between and interconnects said first and second wall segments.

16. An assembly according to claim 15, wherein said mounting wall portion includes an opening extending therethrough adjacent said first longitudinal edge, said opening dimensioned to receive said second and third wall segments of said panel engaging portion of said mounting bracket such that said wall panel can be at least partially supported along said third wall segment of said panel engaging portion.

17. An assembly according to claim 16, wherein said opening in said mounting wall portion of said wall panel has a cross-sectional dimension in said heightwise direction, and said second wall segment of said panel engaging portion of said mounting bracket has a cross-sectional length in said heightwise direction that is greater than said cross-sectional dimension of said opening.

18. A mounting bracket and wall panel kit for installation on an associated wall structure, said kit comprising:

a wall panel formed from thin-walled material having a first panel side, a second panel side opposite said first panel side and a substantially uniform wall thickness between said first and second panel sides, said wall panel extending longitudinally between a first end and a second end spaced from said first end such that a wall panel length is defined between said first and second ends, said wall panel including:

a first longitudinal edge and a second longitudinal edge spaced apart from said first edge such that a wall panel height is defined between said first and second edges;

a first joint element extending lengthwise along said first edge, and a second joint element extending lengthwise along said second edge, said first and second joint elements dimensioned to cooperatively interengage a corresponding one of associated first and second joint elements on an associated second wall panel;

a mounting wall portion extending lengthwise along said first edge and disposed outwardly of said first joint element in a heightwise direction; and, a plurality of mounting brackets dimensioned to operatively engage said mounting wall portion of said wall panel with each of said plurality of mounting brackets including:

a fastening wall portion extending in a heightwise direction and dimensioned to project outwardly beyond said mounting wall portion of said wall panel; and, a panel engaging portion including first and second wall segments dimensioned to receive said mounting wall portion of said wall panel such that said first wall segment can abuttingly engage said first panel side of said wall panel and said second wall segment can abuttingly engage said second panel side of said wall panel.

19. A kit according to claim 18, wherein said wall panel includes a sealing element extending lengthwise along one of said first joint element and said second joint element.

20. A kit according to claim 18 further comprising a plurality of threaded fasteners dimensioned to extend through corresponding openings in at least one of said first wall segment and said second wall segment of said panel-engaging portion of each of plurality of mounting brackets.

* * * * *